United States Patent [19]

Teichmann et al.

[11] 4,381,228

[45] Apr. 26, 1983

[54] PROCESS AND COMPOSITION FOR THE ELECTRODEPOSITION OF TIN AND TIN ALLOYS

[75] Inventors: Robert J. Teichmann, Belleville; Linda J. Mayer, Denville, both of N.J.

[73] Assignee: Occidental Chemical Corporation, Warren, Mich.

[21] Appl. No.: 274,084

[22] Filed: Jun. 16, 1981

[51] Int. Cl.[3] ..... C25D 3/32; C25D 3/60

[52] U.S. Cl. ..... 204/44; 204/435; 204/54 R

[58] Field of Search ..... 204/43 S, 44, 54 R, 204/120, 123; 106/1.25

[56] References Cited

U.S. PATENT DOCUMENTS 3,002,901 10/1961 Seyb ..... 204/43 S
3,677,907 7/1972 Brown et al. ..... 204/43 S X
3,917,486 11/1975 Schneble ..... 106/1.25

FOREIGN PATENT DOCUMENTS 5890 12/1979 European Pat. Off ..... 204/44

*Primary Examiner*—G. L. Kaplan
*Attorney, Agent, or Firm*—Richard P. Mueller

[57] ABSTRACT

An electroplating bath for the high speed deposition of bright metallic tin utilizing tin fluoroborate and sulfuric acid as the electrolyte; wherein, in addition to certain other additives, the bath contains a perfluoroalkyl sulfonate wetting agent to promote anode corrosion. Brighteners used in the system include aromatic amines and aliphatic aldehydes. For certain purposes it may be advantageous to include boric acid as part of the electrolyte; and, in other instances, to use an aromatic sulfonic acid to enhance bath stability and brightness. The method for utilizing a bath containing tin fluoroborate in a sulfuric acid matrix containing these perfluoroalkyl sulfonate wetting agents is also described.

14 Claims, No Drawings

PROCESS AND COMPOSITION FOR THE ELECTRODEPOSITION OF TIN AND TIN ALLOYS

RELATED INVENTION

This application is related to copending U.S. Patent Application Ser. No. 250,373, filed Apr. 2, 1981, now U.S. Pat. No. 4,347,107 the specification of which is incorporated herein by reference.

FIELD OF THE INVENTION

The present invention relates to an improved tin electroplating bath having a bath soluble source of divalent tin, preferably tin fluoroborate and wherein sulfuric acid is the electrolyte or acid matrix. A bright, high speed tin electroplating solution is attained.

BACKGROUND OF THE INVENTION

As set forth in the related copending Ser. No. 250,373, there is a substantial body of prior art patents concerned with tin or tin alloy electroplating baths and processes for utilizing the same. Some of the more relevant patents for the present purposes include U.S. Pat. Nos. 3,730,853 (Sedlacek et al.); 3,749,649 (Valayil); 3,769,182 (Beckwith et al.); 3,785,939 (Hsu); 3,850,765 (Karustis, Jr. et al.) 3,875,029 (Rosenberg et al.); 3,905,878 (Dohi et al.) 3,926,749 (Passal); 3,954,573 (Dahlgren et al.); 3,956,123 (Rosenberg et al.); 3,977,949 (Rosenberg); 4,000,047 (Ostrow et al.); 4,135,991 (Canaris et al.); 4,118,289 (Hsu); and British Pat. Nos. 1,351,875 and 1,408,148.

It is known from the prior art, as represented by the patents referred to above that tin sulfate and tin fluoroborate are generally employed as sources of the divalent tin bath component, whereas the electrolyte is selected from either sulfuric acid or fluoroboric acid.

In many applications, sulfuric acid, as the electrolyte or acid matrix, would be less corrosive than fluoroboric acid. Thus, from a commercial standpoint, it would be desirable to have available a bright, high speed tin electroplating solution which utilizes sulfuric acid rather than fluoroboric acid. It has been found, however, that when sulfuric acid is used, there is poor anode corrosion and undesirable polarization and current drop result.

Moreover, because it is very time consuming to dissolve tin sulfate in the bath, formulation of the initial bath and its replenishment during use would be greatly simplified if tin fluoroborate were used as the source of divalent tin, instead of tin sulfate. It has been found, however, that such use of tin fluoroborate, with the sulfuric acid electrolyte, compounds the problem of poor anode corrosion and its resulting undesirable effects.

OBJECTS OF THE INVENTION

One object of the present invention is to provide a bright, high speed tin electroplating bath utilizing sulfuric acid as the electrolyte or acid matrix.

Another object of the present invention is to provide a tin electroplating bath made up from tin fluoroborate and sulfuric acid which overcomes the anode corrosion problem and its attendant disadvantages.

A further object of the present invention is to provide a bright, high speed tin electroplating bath characterized by good anode corrosion as well as enhanced stability and brightness.

These and other objects will become more readily apparent from the ensuing description and illustrative embodiments of the present invention.

SUMMARY OF THE INVENTION

In accordance with the present invention it has now been found that by utilizing a certain type of wetting agent in formulating a tin electroplating bath having a sulfuric acid electrolyte or acid matrix, the problem of poor anode corrosion is avoided, even when tin fluoroborate is used as the source of divalent tin in the bath. More specifically, the wetting agent is a bath soluble perfluoroalkyl sulfonate or perfluoroalkyl sulfonic acid. Additionally, the bath may also contain one or more primary and supplemental grain refiners, brighteners and additives which will promote and/or enhance bath stability.

DETAILED DESCRIPTION OF THE INVENTION

The electroplating baths of this invention are formulated with divalent tin in the form of a bath soluble compound. Typical of such compounds are stannous sulfate, stannous fluoroborate and stannous chloride. Of these, the preferred source of divalent tin is stannous fluoroborate. The electrolyte or acid matrix of these baths is sulfuric acid. The sulfuric acid is present in an amount sufficient to provide conductivity, maintain bath pH below 2.0 and maintain the solubility of metal salts.

The bath soluble perfluoroalkyl sulfonate and sulfonic acid wetting agents are anionic fluorochemicals which, when added to the bath, have been found to promote anode corrosion and thereby prevent current drop in the system.

More specifically, these compounds have the formula:

$$R_FSO_3X$$

where $R_F$ is a straight, branched or cyclic perfluorinated fluorocarbon radical having 4 to 18 carbon atoms; and X is a cation which does not adversely affect the solubility of the wetting agent in the bath, the appearance of the electrodeposit or the operation of the process. Typical of such cations are hydrogen, the alkali metals, $NH_4$, alkaline bath metals, nickel, iron, tin and amino groups.

Wetting agents of this type are manufactured and sold by the 3M Company under the trademark "FLUORAD". Particularly preferred for use in the present invention are the potassium perfluoroalkyl sulfonates, which are designated by the 3M Company as Fluorad FC-95 and Fluorad FC-98.

Both FC-95 and FC-98 decompose at 390 degrees C. In a 0.1% aqueous solution FC-95 has a pH of 7–8, while FC-98 has a pH of 6–8. FC-98 is slightly less surface active and is capable of producing foam that is less dense and less stable. Both types have outstanding chemical and thermal stability, especially in acidic and oxidizing systems.

The method of preparing these perfluoroalkyl sulfonates is disclosed in U.S. Pat. No. 2,519,983 to Simons; while a prior art use of such surfactants as mist surpressants in chromium electroplating is illustrated by U.S. Pat. No. 2,750,334 to Brown. The teachings of these patents are incorporated herein by reference.

Other surfactants or wetting agents have been tried in place of the above described perfluoroalkyl sulfonates, but none of those tested promoted anode corrosion and a drop in current resulted. These materials included nonionic fluorocarbon surfactants and several anionic sulfated or sulfonated alkyl and aryl surfactants. Attempts were also made to promote anode corrosion and thereby prevent current drop in the tin fluoroborate/-sulfuric acid system, without the addition of wetting agents. Efforts to promote the necessary anode corrosion by increasing sulfuric acid concentration were not successful. Thus, for example, by doubling the sulfuric acid concentration the tin concentration decreased by half with tin sulfate precipitation. Elevated operating temperatures were also tested to determine their effect on anode corrosion in this tin system. It was found, however, the elevated operating temperatures such as 100 degrees F. and 190 degrees F. did not alleviate current drop. Thus, the ability of the perfluoroalkyl sulfonates of the present invention to promote anode corrosion appears to be unexpected in the present tin electroplating systems.

The brightener system that may be used in the present tin electroplating bath will comprise one or more aromatic amines and, most preferably will comprise a combination of one or more aromatic amines and aliphatic aldehydes. The aromatic or aryl amines useful for the present purposes include o-toluidine; p-toluidine; m-toluidine; aniline; and o-chloroaniline. For most purposes the use of o-chloroaniline is especially preferred.

Suitable aliphatic aldehydes are those containing from 1 to 4 carbon atoms and include, for example, formaldehyde, acetaldehyde, propionaldehyde, butyraldehyde, crotonaldehyde, etc. In this invention the preferred aldehyde is formaldehyde or formalin, a 37% solution of formaldehyde.

Nonionic surfactants may also be employed in the bath to provide grain refinement of the electrodeposit. These can be commercially available materials such an nonyl phenoxy polyethylene oxide ethanol (IGEPAL C0630 and Triton QS-15); ethoxylated alkylolamide (AMIDOX L5 and C3); alkyl phenyl polyglycol ether ethylene oxide (NEUTROWYX 675) and the like.

The nonionic surface active agents which have been found to be particularly effective for the present purposes are the polyoxyalkylene ethers, where the alkylene group contains from 2 to 20 carbon atoms. Polyoxyethylene ethers having from 10 to 20 moles of ethylene oxide per mole of lipophilic groups are preferred, and include such surfactants as polyoxyethylene lauryl ether (sold under the tradename Brij 35-SP).

An aromatic sulfonic acid compound may also be used in conjunction with the bath ingredients set forth above. These sulfonic acid compounds maintain stability of the plating bath and provide supplemental brightening and grain refinement to the electrodeposit. Preferred aromatic sulfonic acids for these purposes are:

o-cresol sulfonic acid,
m-cresol sulfonic acid and
phenol sulfonic acid.

Other phenol sulfonic acid derivatives of phenol and cresol which could be employed are, for example:

2,6-dimethyl phenol sulfonic acid,
2-chloro, 6-methyl phenol sulfonic acid,
2,4-dimethyl phenol sulfonic acid,
2,4,6-trimethyl phenol sulfonic acid,
m-cresol sulfonic acid, and
p-cresol sulfonic acid.

Sulfonic acid derivatives of alpha- and beta-naphthols are also possible candidates for the aromatic sulphonic acid ingredient. Additionally, the bath soluble salts of the above acids, such as the alkali metal salts, may be used instead of or in addition to the acid.

In some instances, where stannous fluoroborate is used as the source of divalent tin, it has been found to be useful to incorporate boric acid in the bath to suppress the formation of HF during the plating operation. Where boric acid is used, it will be present in an amount at least sufficient to provide the desired surpression of HF.

In formulating the plating baths of the present invention, the divalent tin compound will be used in an amount at least sufficient to deposit tin on the substrate to be plated, up to its maximum solubility in the bath. The sulfuric acid will be present in an amount sufficient to maintain the pH of the plating bath not in excess of about 2.0. The aromatic amine or the combination of the aromatic amine and the aliphatic aldehyde are present in amounts at least sufficient to impart brightness to the tin electrodeposit, while the nonionic surfactant is present in the bath in a grain refining amount. The aromatic sulfonic acid derivative is present in an amount sufficient to maintain the stability of the plating bath and enhance the brightness of the electrodeposit.

More specifically, the ingredients of the aqueous electroplating baths of this invention will be present in amounts within the following ranges:

| Ingredients | Amounts (grams/liter) General | Preferred |
|---|---|---|
| (1) Tin (II), as Stannous Fluoroborate, Sulfate or Chloride | 5–50 | 25–35 |
| (2) Sulfuric Acid | 50–350 | 100–200 |
| (3) Aromatic Amine | 0.3–15 | 1.5–1.5, cc/l |
| (4) Aliphatic Aldehyde | 0.5–20 | 5–10 cc/l |
| (5) Nonionic Surfactant | 0.1–20 | 0.5–1.0 |
| (6) Aromatic Sulfonic Acid Derivative | 0.5–30 | 3–9 |
| (7) Alkali Metal or Amine Perfluoroalkyl Sulfonates | 0.01–10 | 0.075–2.5 |
| (8) Boric Acid | 0–50 | 0–30 |

The pH of the bath will not be in excess of about 2.0 and will usually be less than about 1, with ranges from about 0 to 0.5 being typical and ranges from about 0 to 0.3 being preferred. Electroplating temperatures and current densities used will be those at which there are no adverse effects on either the plating bath or the electrodeposit produced. Typically, the temperatures will be from about 10 degrees to 40 degrees C., with temperatures of about 15 degrees to 25 degrees C. being preferred. Typical current densities will be about 10 to 400 Amps/square foot (ASF) and preferably about 25 to 200 ASF.

The substrates which may be satisfactorily plated utilizing the electroplating baths of this invention include most metallic substrates, except zinc, such as copper, copper alloys, iron, steel, nickel, nickel alloys and the like. Additionally, non-metallic substrates that have been treated to provide sufficient conductivity may also be plated with the bath and process of the present invention.

Another aspect of this invention involves the discovery that copper and rhodium metals can be codeposited with tin on the substrates when utilizing the electroplating baths described above without additional additives or complexing agents. In contrast, metals such as nickel, iron and indium did not codeposit under the same conditions.

Typically, the copper or rhodium is added to the bath as bath soluble compounds, preferably as the sulfate. The amounts of such compounds added will be sufficient to provide up to about 5% by weight of copper or rhodium, alloyed with tin, in the electrodeposit. Typical amounts of copper and rhodium in the electroplating baths to provide such quantities of the metal in the electrodeposit are about 0.2 to 4 grams/liter and 0.2 to 2 grams/liter, respectively.

The invention will be more fully understood by reference to the following embodiments:

EXAMPLE I

An electroplating bath was prepared from the ingredients set forth below:

| Ingredients | Amount (g/l) |
|---|---|
| Tin (II), as stannous fluoroborate | 30 |
| Sulfuric Acid | 172 |
| o-Chloroaniline | 1.0, cc/l |
| Formalin | 8, cc/l |
| Polyoxyethylene lauryl ether (Brij 35-SP | 0.7 |
| Potassium perfluoroalkyl sulfonate (FC-98) | 0.2 |
| Water | Remainder |

This resulting stable bath was operated at room temperature, 50 ASF, with rapid agitation and pure tin anodes to plate a panel. The tin deposit thus formed had a very bright appearance, no current drop occurred.

EXAMPLE II

An electroplating bath was prepared from the following ingredients:

| Ingredients | Amount (g/l) |
|---|---|
| Tin II, as stannous Fluoroborate | 30 |
| Sulfuric Acid | 172 |
| Boric Acid | 1.5 |
| Formalin | 8 cc/l |
| o-Chloroaniline | 1.0 cc/l |
| Potassium Perfluoroalkyl sulfonate (FC-98) | 0.2 |
| Polyoxyethylene lauryl ether | 0.7 |
| Water | Remainder |

The resulting bath was operated at 50 ASF and produced a bright tin deposit. Again, there was no current drop.

It will be further understood that the foregoing examples are illustrative only, and that variations and modifications may be made without departing from the scope of the invention.

What is claimed is:

1. An aqueous electroplating bath for the electrodeposition of bright, metallic tin or alloys of tin with copper or rhodium which comprises from 5 to 50 g/l of a bath soluble di-valent tin compound, sulfuric acid in an amount sufficient to maintain the bath pH not in excess of about 2.0, 0.01 to 10 g/l of a perfluoroalkyl sulfonate wetting agent, 0.3 to 15 cc/l of an aromatic amine brightener, 0.1 to 20 g/l of a non-ionic surfactant, and 0.5 to 30 g/l of an aromatic sulfonic acid, said bath being substantially free of other sulfur components.

2. The electroplating bath of claim 1 wherein the divalent tin compound is stannous fluoroborate.

3. The electroplating bath of claim 2 wherein there is also present 0.5 to 20 cc/l of an aliphatic aldehyde brightener.

4. The electroplating bath of claim 3 wherein the perfluoroalkyl sulfonate wetting agent is an alkali metal perfluoroalkyl sulfonate.

5. The electroplating bath of claim 4 wherein the alkali metal perfluoroalkyl sulfonate is potassium perfluoroalkyl sulfonate.

6. The electroplating bath of claim 5 wherein the nonionic surfactant is a polyoxyalkylene ether.

7. The electroplating bath of claim 6 wherein the polyoxyalkylene ether is polyoxyethylene lauryl ether.

8. The electroplating bath of claim 5 wherein said aromatic amine is o-chloroaniline.

9. The electroplating bath of claim 5 wherein said aliphatic aldehyde is formaldehyde.

10. The electroplating bath of claim 5 wherein the aromatic sulfonic acid is selected from the group consisting of cresol and phenol sulfonic acids.

11. The electroplating bath of claim 10 wherein the aromatic sulfonic acid is o-cresol sulfonic acid.

12. The electroplating bath of claim 5 which also contains an alloying metal selected from the group consisting of copper and rhodium metals.

13. The electroplating bath of claim 12 wherein the alloying metal is in the form of its sulfate salt.

14. A method for the deposition of bright metallic tin on a substrate which comprises electroplating said substrate in the plating bath of claims 2, 3, 4, 5, 6, 7, 8, 9, 10, 11, 12, 13 or 1 for a period of time sufficient to form the desired electrodeposit on the substrate.

* * * * *